United States Patent [19]

Trzasko et al.

[11] Patent Number: 4,721,655

[45] Date of Patent: Jan. 26, 1988

[54] PAPER SIZE COMPOSITIONS

[75] Inventors: Peter T. Trzasko, Plainsboro; Martin M. Tessler, Edison; Ralph Trksak, Manville; Wadym Jarowenko, Green Brook, all of N.J.

[73] Assignee: National Starch and Chemical Corporation, Bridgewater, N.J.

[21] Appl. No.: 44,171

[22] Filed: Apr. 30, 1987

Related U.S. Application Data

[62] Division of Ser. No. 811,869, Dec. 20, 1985, Pat. No. 4,687,519.

[51] Int. Cl.[4] ..... B32B 27/08

[52] U.S. Cl. ..... 428/530; 162/175; 162/178; 162/179; 428/537.5

[58] Field of Search ..... 428/530, 537.5; 162/158, 175, 178, 179

[56] References Cited

U.S. PATENT DOCUMENTS

| | | | |
|---|---|---|---|
| Re. 28,809 | 5/1976 | Tessler | 260/233.5 |
| Re. 29,960 | 4/1979 | Mazzarella et al. | 162/158 |
| 2,661,349 | 12/1953 | Caldwell et al. | 260/224 |
| 2,876,217 | 3/1959 | Paschall | 260/233.5 |
| 3,102,064 | 8/1963 | Wurzburg et al. | 162/158 |
| 3,821,069 | 6/1974 | Wurzburg | 162/158 |
| 3,968,005 | 7/1976 | Wurzburg | 162/158 |
| 4,029,272 | 4/1977 | Tessler | 536/107 |
| 4,214,948 | 7/1980 | Mazzarella et al. | 162/158 |
| 4,239,592 | 12/1980 | Gaspar et al. | 162/175 |
| 4,687,519 | 8/1987 | Trzasko et al. | 106/211 |

FOREIGN PATENT DOCUMENTS

| | | |
|---|---|---|
| 1069410 | 1/1980 | Canada . |
| 0014520 | 6/1980 | European Pat. Off. . |

*Primary Examiner*—Marion C. McCamish

*Attorney, Agent, or Firm*—Ellen T. Dec; Edwin M. Szala

[57] ABSTRACT

A paper size having the ability to be prepared under low shear conditions and having sizing properties superior to the sizes of the prior art may be prepared comprising water and 0.1 to 15% by weight of at least one hydrophobic sizing agent and 0.4 to 30% by weight of a jet cooked dispersion of a long chain alkyl derivative of starch or a dispersion of a corresponding gum derivative.

20 Claims, No Drawings

PAPER SIZE COMPOSITIONS

This application is a division, of application Ser. No. 811,869, filed Dec. 20, 1985, now U.S. Pat. No. 4,687,519.

BACKGROUND OF THE INVENTION

This invention relates to a paper size composition and to a method for sizing paper and paperboard therewith. More particularly, the invention relates to a paper size composition comprising a mixture of an internal size and a long chain alkyl derivative of starch or gum.

Paper and paperboard are often internally sized with various hydrophobic materials including, for example, alkyl ketene dimers, anhydrides of fatty acids, maleated triglycerides, maleated alpha-olefins, maleated fatty acids as well as substituted linear or cyclic dicarboxylic acid anhydrides. These sizes are introduced during the actual paper making operation and, as such, require that the sizing compounds be uniformly dispersed throughout the fiber slurry in a small particle size.

It has been general practice to add the sizes in the form of an aqueous emulsion prepared with the aid of emulsifying agents including, for example, cationic or ordinary starches, carboxymethyl cellulose, natural gums, gelatin, cationic polymers or polyvinyl alcohol, all of which act as protective colloids. The use of such emulsifying agents with or without added surfactants did, however, suffer from several inherent deficiencies in commercial practice. A primary deficiency concerned the necessity of utilizing relatively complex, expensive and heavy equipment capable of exerting high homogenizing shear and/or pressures, together with rigid procedures regarding emulsifying proportions and temperatures, etc., for producing a satisfactory stable emulsion of the particular size. Additionally, the use of many surfactants in conjunction with protective colloids was found to create operational problems in the paper making process such as severe foaming of the stock and/or loss in sizing.

With particular reference to the procedures of the prior art which utilized these internal sizing agents, it was necessary in commercial practice to pre-emulsify with cationic starch and/or other hydrocolloids using relatively rigid procedures with elevated temperatures to cook the starch or hydrocolloids and high shearing and/or high pressure homogenizing equipment. Unless these complicated procedures were carefully followed difficulties such as deposition in the paper system, quality control problems and generally unsatisfactory performance were often encountered.

Many of these problems were overcome by the teachings of U.S. Pat. No. 4,214,948 and U.S. Pat. No. Re. 29,960 which disclosed the use of a size mixture of specific sizing agents and polyoxyalkylene alkyl or alkylaryl ethers or their corresponding mono- or di-esters, which mixtures were easily emulsifiable with water in the absence of high shearing forces and under normal pressure. Despite the contributions of the latter patents there remains a need in the art for emulsions exhibiting improved sizing performance and operability.

SUMMARY OF THE INVENTION

We have now found that a paper size having the ability to be prepared under low shear conditions and having sizing properties superior to the sizes of the prior art may be prepared comprising water and 0.1 to 15% by weight of at least one hydrophobic sizing agent and 0.4 to 30% by weight of a jet cooked dispersion of a long chain alkyl derivative of starch or a dispersion of a corresponding gum derivative. Particularly preferred paper sizes of the present invention are those prepared using substituted linear or cyclic dicarboxylic acid anhydrides as the hydrophobic sizing agents.

It is hypothesized that the superior and synergistic sizing properties provided by the paper sizes of the invention are contributed by a number of factors. Among these factors are the elimination of the use of surfactants (which are themselves desizing agents); and the reduction in hydrolysis of the reactive sizing agent which keeps the system cleaner and consequently improves the runnability of the machine and makes size useage more efficient.

A further advantage of the use of these polysaccharide based emulsifiers disclosed herein is their ability to "scavenge" or to emulsify any residual sizing agent present on the metal surfaces of the paper manufacturing equipment thereby further enhancing the sizing of the paper sheets made therewith as well as improving the economics of the entire system.

DETAILED DESCRIPTION OF THE PREFERRED EMBODIMENTS

The preferred sizing compounds contemplated for use herein are the cyclic dicarboxylic acid anhydrides containing hydrophobic substitution. Those substituted cyclic dicarboxylic acid anhydrides most commonly employed as paper sizes are represented by the following formula:

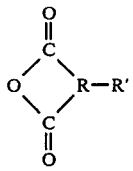

wherein R represents a dimethylene or trimethylene radical and wherein R′ is a hydrophobic group containing more than 4 carbon atoms which may be selected from the class consisting of alkyl, alkenyl, aralkyl or aralkenyl groups. Sizing compounds in which R′ contains more than twelve carbon atoms are preferred.

Representative of those cyclic dicarboxylic acid anhydrides which are broadly included within the above formula are sizing agents exemplified in U.S. Pat. Nos. 3,102,064; 3,821,069, and 3,968,005 as well as by Japanese Pat. No. 95,923 and Sho-59-144697.

Thus, the substituted cyclic dicarboxylic acid anhydrides may be the substituted succinic and glutaric acid anhydrides of the above described formula including, for example, iso-octadecenyl succinic acid anhydride, n- or iso-hexadecenyl succinic acid anhydride, dodecenyl succinic acid anhydride, dodecyl succinic acid anhydride, decenyl succinic acid anhydride, octenyl succinic acid anhydride, triisobutenyl succinic acid anhydride, etc.

The sizing agents may also be those of the above described formula which are prepared employing an internal olefin corresponding to the following general structure:

$$R_x—CH_2—CH=CH—CH_2—R_y$$

wherein $R_x$ is an alkyl radical containing at least four carbon atoms and $R_y$ is an alkyl radical containing at least four carbon atoms and which correspond to the more specific formula:

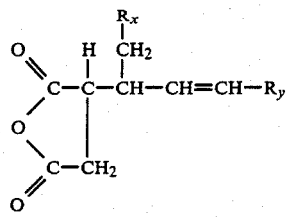

wherein $R_x$ is an alkyl radical containing at least 4 carbon atoms and $R_y$ is an alkyl radical containing at least 4 carbon atoms, and $R_x$ and $R_y$ are interchangeable. Specific examples of the latter sizing compounds include (1-octyl-2-decenyl)succinic acid anhydride and (1-hexyl-2-octenyl)succinic acid anhydride.

The sizing agents may also be prepared employing a vinylidene olefin corresponding to the following general structure

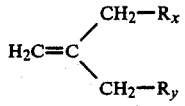

wherein $R_x$ and $R_y$ are alkyl radicals containing at least 4 carbon atoms in each radical. These compounds correspond to the specific formula:

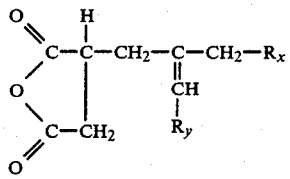

wherein $R_x$ is an alkyl radical containing at least 4 carbon atoms and $R_y$ is an alkyl radical containing at least 4 carbon atoms and $R_x$ and $R_y$ are interchangeable and are represented by 2-n-hexyl-1-octene, 2-n-octyl-1-dodecene, 2-n-octyl-1-decene, 2-n-dodecyl-1-octene, 2-n-octyl-1-octene, 2-n-octyl-1-nonene, 2-n-hexyl-decene and 2-n-heptyl-1-octene.

The sizing agents may also include those as described above prepared employing an olefin having an alkyl branch on one of the unsaturated carbon atoms or on the carbon atoms contiguous to the unsaturated carbon atoms. Representative of the latter olefins are n-ocetene-1; n-dodecene-1; n-octadecene-9; n-hexene-1; 7,8-dimethyl tetradecene-6; 2,2,4,6,6,8,8-heptamethylnone-4; 2,2,4,6,6,8,8-heptamethylnone-3; 2,4,9,11-tetramethyl-5-ethyldodecene5; 6,7-dimethyldodecene-6; 5-ethyl-6-methylundecene-5; 5,6-diethyldecene-5; 8-methyltridecene-6; 5-ethyldodecene-6; and 6,7-dimethyldodecene-4.

A second class of hydrophobic sizing agents useful herein are the higher organic ketene dimers of the following formula:

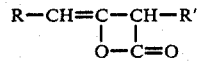

wherein R and R′ are independently chosen from the group consisting of saturated and unsaturated alkyl radicals having at least eight carbon atoms, cycloalkyl radicals having at least six carbon atoms, aryl, aralkyl and alkylaryl radicals.

Specific examples of sizing compounds falling within this class include: octyl, decyl, dodecyl, tetradecyl, hexadecyl, octadecyl, eicosyl, docosyl, tetracosyl, phenyl, benzyl, B-naphthyl and cyclohexyl ketene dimers, as well as the ketene dimers prepared from montanic acid, naphthanic acid, Δ9,10-decylenic acid, Δ9,10-dodecylenic, palmitoleic acid, oleic acid, ricinoleic acid, petroselinic acid, vaccenic acid, linoleic acid, tartaric acid, linolenic acid, eleostearic acid, licanic acid, parinaric acid, gadoleic acid, arachidonic acid, cedtoleic acid, erucic acid and selacholeic acid as well as ketene dimers prepared from naturally occurring mixtures of fatty acids, such as those mixtures found in coconut oil, babassu oil, palm kernal oil, palm oil, olive oil, peanut oil, rape oil, beef tallow, lard (leaf) and whale blubber. Mixtures of any of the above-named compounds with each other may also be used. The preparation of these compounds is known to those skilled in the art. Typical commercially available products which may be employed include Aquapel 364, Aquapel 421, Aquapel 467 and Hercon 33 all tradenames for products sold by Hercules Incorporated, Wilmington, Del.

Also useful in the preparation of the sizes disclosed herein are the heterocyclic organic sizing agents including maleated triglycerides, maleated alpha-olefins, maleated fatty acid esters, or mixtures thereof. The latter class is particularly exemplified by sizing agents which comprise the reaction product of maleic anhydride and an unsaturated triglyceride oil wherein the triglyceride oil has an iodine value of at least about 50. By the term "triglyceride oil" is meant the triester of glycerol and the same mixed fatty acids. Fatty acids refer to straight chain monocarboxylic acids having a carbon chain length of from $C_3$ to $C_{30}$. Specific examples of such sizing agents include the condensation reaction product of maleic anhydride with soy bean oil, cottonseed oil, corn oil, safflower oil, fish oil, linseed oil, peanut oil, citicica oil, dehydrated castor oil, hempseed oil, and mixture thereof. This class of heterocyclic sizing agents is disclosed in more detail in Canadian Pat. No. 1,069,410 issued Jan. 8, 1980 to Roth et al.

The polysaccharide derivatives used as emulsifiers herein are the long chain alkyl derivatives of starches and gums, specifically the respective long chain cationic ethers, succinate esters and fatty acid esters thereof. While the emulsification properties of these derivatives have been known, their ability to produce stable emulsions with reactive size agents in addition to their synergistic effect on improving the sizing effectiveness thereof is unexpected.

The specific polysaccharide derivatives which find use herein include the hydrophobic starch or gum ether or ester derivatives wherein the ether or ester substitutent comprises a saturated of unsaturated hydrocarbon chain of at least 5, and preferably less than 22 carbon atoms.

The applicable starch bases which may be used in the derivatives herein include any amylaceous substance such as untreated starch, as well as starch derivatives including dextrinized, hydrolyzed, oxidized, esterified and etherified starches still retaining amylaceous material. The starches may be derived from any sources including, for example, corn, high amylose corn, wheat, potato, tapioca, waxy maize, sago or rice. Starch flours may also be used as a starch source.

Similarily, any polygalactomannons may be employed in the derivatives for use herein. These polygalactomannons or "gums" are commonly found in the endosperm of certain seeds of the plant family "Leguminosae", such as the seeds of guar, locust bean, honey locust, flame tree and the like. The gums suitable for use herein may be in the form of endosperm "splits" or preferably the purified or unpurified ground endosperm (generally called flour) derived from the splits. Also included are gum degradation products resulting from the hydrolytic action of acid, heat, shear, and/or enzymes; oxidized gums; derivatized gums such as ethers and esters coantaining non-ionic, anionic cationogenic, and/or cationic groups; and other typical carbohydrate modifications.

The preferred gums are guar gum and locust bean gum because of their commercial availability. Guar gum is essentially a straight chain polygalactomannan wherein the branching takes place on alternate mannopyranosyl units thus providing a galactopyranosyl to mannopyranosyl ratio of 1:2. Locust bean gum has a similar structure wherein the galactopyranosyl to mannopyranosyl ratio is 1:4 but wherein the branching is not uniformly spaced.

By the term "hydrophobic starch or gum" is meant a starch or gum ether or ester derivative wherein the ether or ester substituent comprises a saturated or unsaturated hydrocarbon chain of at least 5 carbon atoms. It should be understood that the hydrocarbon chain may contain some branching; however, those derivatives wherein the hydrocarbon chain is unbranched are preferred. It should also be understood that the ether or ester substituent may contain other groups in addition to the hydrocarbon chain as long as such groups do not interfere with the hydrophobic properties of the substituent.

A suitable class of reagents for preparing half-acid esters useful herein include substituted cyclic dicarboxylic acid anhydrides such as those described in U.S. Pat. No. 2,661,349 (issued on Dec. 1, 1953 to Caldwell et al.) having the structure

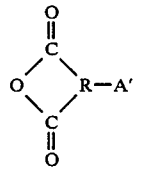

wherein R is a dimethylene or trimethylene radical and A' comprises a hydrocarbon chain of at least 5, preferably 5–14, carbon atoms. The substituted cyclic dicarboxylic acid anhydrides falling within the above structural formula are the substituted succinic and glutaric acid anhydrides. In addition to the hydrocarbon chain substituent other substituent groups such as sulfonic acid or lower alkyl groups which would not affect sizing performance may be present.

Another suitable class of reagents for preparing ester derivatives useful herein include the imidazolides or N,N'-disubstituted imidazolium salts of carboxylic or sulfonic acids such as those described in U.S. Pat. No. Re. 28,809 (issued May 11, 1976 to M. Tessler) which is a reissue of U.S. Pat. No. 3,720,663 (issued on Mar. 13, 1973 to M. Tessler) and U.S. Pat. No. 4,020,272 (issued Apr. 26, 1977 to M. Tessler) having the general formula

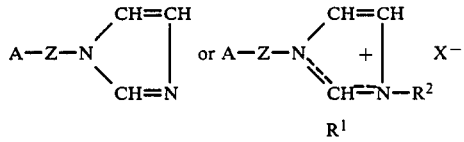

wherein Z is

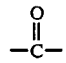

or —$SO_2$—, A comprises a hydrocarbon chain of at least 5, preferably 5 to 14, carbon atoms, $R^1$ is H or $C_1$–$C_4$ alkyl, $R^2$ is $C_1$–$C_4$ alkyl, and $X^-$ is an anion.

A third class of reagents useful herein include the etherifying reagents described in U.S. Pat. No. 2,876,217 (issued on Mar. 3, 1959 to E. Paschall) comprising the reaction product of an epihalohydrin with a tertiary amine having the structure

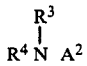

wherein $R^3$ and $R^4$ are independently H or a $C_1$–$C_4$ alkyl and $A^2$ comprises a hydrocarbon chain of at least 5, preferably 5 to 14, carbon atoms.

The starch etherification or esterification reactions may be conducted by a number of techniques known in the art and discussed in the literature employing, for example, an aqueous reaction medium, an organic solvent medium, or a dry heat reaction technique. See, for example R. L. Whistler, Methods in Carbohydrate Chemistry, Vol. IV, 1964, pp. 279–311; R. L. Whistler et all., Starch: Chemistry and Technology, Second Edition, 1984, pp. 311–366; and R. Davidson and N. Sittig, Water-Soluble Resins, 2nd Ed., 1968, Chapter 2. The starch derivatives herein are preferably prepared employing an aqueous reaction medium at temperatures between 20° and 45° C.

For use herein, the starch derivatives may be produced either in gelatinized or ungelatinized form. The advantage of having the derivative in ungelatinized form is that it may be filtered, washed, dried and conveyed to the mill in the form of a dry powder.

When employing the cyclic dicarboxylic acid anhydride reagents, starch is preferably treated in granular form with the reagents in an aqueous alkali medium at a pH not lower than 7 nor higher than 11. This may be accomplished by suspending the starch in water, to which has been added (either before or after the addition of the starch) sufficient base such as alkali metal hydroxide, alkaline earth hydroxide, quaternary ammonium hydroxide, or the like, to maintain the mixture in an alkaline state during the reaction. The required amount of the reagent is then added, agitation being maintained until the desired reaction is complete. Heat may be applied, if desired, in order to speed the reaction; however, if heat is used, temperatures of less than about 40° C. should be maintained. In a preferred method, the alkali and the anhydride reagent are added concurrently to the starch slurry, regulating the rate of flow of each of these materials so that the pH of the slurry remains preferably between 8 and 11.

Due to the greater hydrophobic nature of certain of the substituted cyclic dicarboxylic acid anhydride reagents useful herein (i.e., those having $C_{10}$ or higher substituents), the reagents react with starch in only minor amounts in standard aqueous reactions. In order to improve the starch reaction efficiency, starch is reacted with the hydrophobic reagent under standard aqueous conditions in the presence of at least 5%, preferably 7–15% (based on the weight of the reagent), of a water-soluble organic quaternary salt which is employed as a phase transfer agent. The organic salts, of which trioctylmethyl ammonium chloride or tricaprylylmethyl ammonium chloride are preferably employed, are described in U.S. Pat. No. 3,992,432 (issued Nov. 16, 1976 to D. Napier et al.).

Conventional esterification and etherification techniques are also employed to produce the corresponding hydrophobic gum derivatives. Most commonly, these reactions are carried out under alkaline conditions in a two-phase system of solid gum slurried in an aqueous medium containing a water-miscible solvent.

The proportion of etherifying or esterifying reagent used will vary with the particular reagent chosen (since they naturally vary in reactivity and reaction efficiency), and the degree of substitution desired. Thus, substantial improvements in sizing efficiency have been achieved by using a derivative made with 1% of the reagent, based on the weight of the starch or gum. Depending on the particular derivative being formed, the upper limit of treatment will vary and is limited only by the solubility or dispersibility of the final product. Generally the maximum level will be less than 25% while preferred ranges are on the order of about 3 to 20%, and more preferably 3 to 10%.

In practice, it has been found that the hydrophobic starch or gum derivatives can be most effectively used as emulsifiers herein when dispersed in water in amounts ranging from 2 to 40 parts of the derivative per hundred parts of water.

For use as emulsifiers herein, the starches must be pregelatinized by jet cooking since other methods for preparing starch dispersions have not been found suitable. Jet-cooking is conventional and is described in patents such as U.S. Pat. No. 3,674,555 issued July 4, 1972 to G. R. Meyer et al. A starch slurry is pumped into a heated cooking chamber where pressurized steam is injected into the starch slurry. The cooked starch solution passes from the cooking chamber and exits via an exit pipe. The cook may be used directly in the sizes of the invention or the starch solution may be spray dried and subsequently redispersed. The gums may be readily dispersed in water using conventional procedures, or for example, dispersing in a boiling water bath.

In accordance with the method of this invention, the size mixture is formed by mixing in water 0.1 to 15% by weight of the aforementioned hydrophobic reactive sizing agent with 0.4 to 30% by weight (solids) of the polysaccharide dispersion.

It is to be recognized that mixtures of various combinations of sizing agents and/or polysaccharides may be employed in preparing a particular size mixture, as long as they fall within the scope of this invention.

Pre-emulsification of the size mixture may be readily accomplished by adding the size and polysaccharide dispersion to water in sufficient quantity so as to yield an emulsion containing the sizing agent in a concentration of from about 0.1 to 15% by weight. The aqueous mixture is thereafter sufficiently emulsified merely by passing it through a mixing valve, aspirator or orifice so that the average particle size of the resultant emulsion will average less than about 5 microns. It is to be noted in preparing the emulsion that it is also possible to add the sizing agent and polysaccharide dispersion to the water separately, and that the emulsion may be prepared using continuous or batch methods.

Emulsification of the mixture readily occurs at ambient temperatures. Thus, the emulsification will occur directly in cold water and heating of the water prior to addition of the sizing mixture is unnecessary, although the system is relatively insensitive to heat and temperatures up to about 85° C. may be employed.

As to actual use, no further dilution of the emulsion is generally necessary. The thus-prepared emulsion is simply added to the wet end of the paper making machine or to the stock preparation system so as to provide a concentration of the sizing agent of from about 0.01 to about 2.0% based on dry fiber weight. Within the mentioned range, the precise amount of size which is to be used will depend for the most part upon the type of pulp which is being treated, the specific operating conditions, as well as the particular end use for which the paper product is destined. For example, paper which will require good water resistance or ink holdout will necessitate the use of a higher concentration of size than paper which will be used in applications where these properties are not critical.

Alternatively, the size emulsion may be sprayed onto the surface of the formed web at any point prior to the drying step in the concentrations as prepared so as to provide the required size concentration.

As is conventional in synthetic sizing operations, the size mixtures are used in conjunction with a material which is either cationic or is capable of ionizing or dissociating in such a manner as to produce one or more cations or other positively charged moieties. Among the materials which may be employed as cationic agents are long chain fatty amines, amine-containing synthetic polymers (primary, secondary tertiary or quaternary amine), substituted polyacrylamide, animal glue, cationic thermosetting resins and polyamide-epichlorohydrin polymers. Of particular use are various cationic starch derivatives including primary, secondary, tertiary or quaternary amine starch derivatives and other cationic nitrogen substituted starch derivatives as well as cationic sulfonium and phosphonium starch derivatives. Such derivatives may be prepared from all types of starches including corn, tapioca, potato, waxy maize, wheat and rice. Moreover, they may be in their original granule form or they may be converted to pregelatinized, cold water soluble products. Amphoteric natural and synthetic polymers containing both anionic and cationic groups may also be used effectively to deposit and retain the sizing agent on the fiber. It will be understood that if the hydrophobic polysaccharide employed also contains a cationic functionality on its backbone, the use of additional cationic starch is not required.

Any of the above noted cationic retention agents may be added to the stock, i.e. the pulp slurry, either prior to, along with or after the addition of the size mixture or size emulsion in conventional amounts of at least about 0.01%, preferably 0.025 to 3.0%, based on dry fiber weight. While amounts in excess of about 3% may be used, the benefits of using increased amounts of retention aids for sizing purposes are usually not economically justified.

The size mixtures are not limited to any particular pH range and may be used in the treatment of neutral and alkaline pulp, as well as acidic pulp. The size mixtures may thus be used in combination with alum, which is very commonly used in making paper, as well as other acid materials. Conversely, they may also be used with calcium carbonate or other alkaline materials in the stock.

Subsequent to the addition of the size emulsion and retention aid, the web is formed and dried on the paper making machine in the usual manner. In actual paper machine operations, full sizing is generally achieved immediately off the paper machine. Because of limited drying in laboratory procedures however, further improvements in the water resistance of the paper prepared with the size mixtures of this invention may be obtained by curing the resulting webs, sheets, or molded products. This post-curing process generally involves heating the paper at temperatures in the range of from 80° to 150° C. for a period of from 1 to 60 minutes.

The size mixtures of the present invention may be successfully utilized for the sizing of paper and paperboard prepared from all types of both cellulosic and combinations of cellulosic with non-cellulosic fiber. Also included are sheet-like masses and molded products prepared from combinations of cellulosic and non-cellulosic materials derived from synthetics such as polyamide, polyester and polyacrylic resin fibers as well as from mineral fibers such as asbestos and glass. The hardwood or softwood cellulosic fibers which may be used include bleached and unbleached sulfate (Kraft), bleached and unbleached sulfite, bleached and unbleached soda, neutral sulfite semi-chemical, groundwood, chemigroundwood, and any combination of these fibers. In addition, synthetic cellulosic fibers of the viscose rayon or regenerated cellulose type can also be used, as well as recycled waste papers from various sources.

All types of pigments and fillers may be added in the usual manner to the paper product which is to be sized. Such materials include clay, talc, titanium dioxide, calcium carbonate, calcium sulfate and diatomaceous earths. Stock additives, such as defoamers, pitch dispersants, slimicides, etc. as well as other sizing compounds, can also be used with the size mixtures described herein.

As noted above, the size mixtures described herein, when emulsified under low shear conditions and used in the paper stock system, yield paper products having superior sizing properties. The following examples will further illustrate the embodiments of the present invention. In these examples, all parts given are by weight unless otherwise specified.

EXAMPLES

The following examples describe the preparation of three different types of starch derivatives which are capable of emulsifying reactive sizing agents.

PREPARATION OF STARCH A

This example illustrates a procedure for preparing a converted halfacid ester starch succinate derivative useful herein.

About 100 parts corn starch are slurried in 150 parts water and the pH is adjusted to 7.5 by the addition of dilute sodium hydroxide (3%). A total of 3 parts octenyl succinic acid anhydride (OSA) reagent is added slowly to the agitated starch slurry with the pH maintained at 7.5 by the metered addition of the dilute sodium hydroxide. After the reaction is complete, the pH is adjusted to about 5.5 with dilute hydrochloric acid (3:1). The starch is thereafter recovered by filtration, washed three times with water and air dried. The final product will have a carboxyl content of about 2.5%.

Using the procedure described previously, the following additional OSA polysaccharide derivatives were also prepared:

| Polysaccharide | Treatment Level (%) |
|---|---|
| Corn Starch | 6 |
| Waxy Maize Starch | 1 |
| Waxy Maize Starch | 2 |
| Waxy Maize Starch | 3 |
| Waxy Maize Starch | 5 |
| Waxy Maize Starch | 10 |
| Tapioca Starch | 3 |
| Guar Gum | 25 |
| Waxy Maize Dextrin | 3 |
| 85 Water Fluidity Waxy Maize | 3 |

Longer chain ASA derivatives were prepared using a similiar procedure whereby waxy maize starch and corn starch were treated with 10% tetradecenyl succinic anhydride (TDSA) in the presence of 5–15% (based on TDSA weight) of tricaprylylmethyl ammonium chloride phase transfer agent at a pH of 8.

PREPARATION OF STARCH B

Starch ester derivatives, prepared by employing N,N-disubstituted imidazolium salts of long chain carboxylic acids are also suitable for use herein.

About 100 parts waxy maize was slurried in 150 parts water and the pH adjusted to 8.0 with 3% sodium hydroxide and the reagent slowly added to the starch slurry. The reaction was allowed to proceed for 2 to 3 hours at room temperature while maintaining the pH at 8.0 with the constant addition of 3% sodium hydroxide. When the reaction was complete, the pH of the slurry was adjusted to 4 with 3:1 hydrochloric acid. The starch ester derivative was recovered by filtration, washed three times with pH 4 water, and air dried.

PREPARATION OF STARCH C

Starch ether derivatives, prepared by employing long hydrocarbon chain quaternary amine epoxide reagents, are also suitable for use herein.

About 100 parts of waxy maize was slurried in 150 parts water containing 40 parts sodium sulfate and 3 parts sodium hydroxide. The reagent (10 parts dimethylglycidyl-n-dodecyl ammonium chloride) was added and the mixture was agitated for 16 hours at 40° C. Thereafter the pH was adjusted to 3 with 3:1 hydrochloric acid. The starch ethers were filtered, then washed 3 times with water having a pH of about 3, and air dried.

EXAMPLE #1

A 3% octenyl succinic anhydride modified waxy maize was jet cooked at 150° C. and 6% slurry solids. This cook was diluted to 0.38% solids using tap water and cooled to room temperature.

This cook was used to emulsify an alkenyl succinic anhydride wherein the alkenyl groups contained 15 to 20 carbon atoms (hereinafter referred to as ASA) under low shear conditions at a ratio of 2 parts starch to one part ASA. The resultant emulsion was stable for over 2 hours.

Another emulsion (heretofore called the "standard") was made using a 120° C. jet cook of an amphoteric corn starch, diluted to 0.69% solids and cooled to room temperature. This standard emulsion was made under conditions specified in U.S. Pat. No. Re. 29,960 at a 2:1 ratio of starch to oil, with addition of 7% of a nonyl phenol ethoxylate to the alkenyl succinic anhydride.

A paper pulp suspension was prepared by beating 195 grams of a blend of 70% hardwood/30% softwood kraft pulp fibers in 8 liters of raw tap water (100 ppm total hardness) in a Valley Beater until a Canadian Standard freeness of 400 was reached. This pulp was diluted further with tap water to a total solids of 0.5% and adjusted to pH to 8.5 with sodium hydroxide. 700 ml of this pulp was added to a 1 liter beaker and 5 ml of a 0.35% solution of alum was introduced under agitation and stirred for 30 seconds at 40 RPM. At the 30 second mark, the size emulsion was added and the mixture agitated for another 15 seconds. At this point, 0.25% on the weight of the pulp of an amphoteric corn starch was added, and the agitation stopped after another 15 seconds of mixing. The pulp was then transferred to an 8 inch Williams headbox (filled to within 3 inches of its top with raw tap water).

This mixture of pulp slurry, additives and water was then agitated slowly to evenly distribute the pulp. The headbox drain was opened, causing a vacuum to deposit the pulp fibers and entrapped additives onto an 80 mesh screen placed in the bottom of the Williams headbox. After 5 seconds the screen was removed from the Williams headbox and 2 blotters placed on top of the fiber mat present on top of the screen. A couch plate was then placed on these blotters for 30 seconds, removed and the top blotter was removed.

The sheet and the two blotters were gently removed from the screen, two blotters placed on the underside of the pulp mat and this composite pressed in a Williams press for two minutes at 1200 PSI. The pulp mat and blotters were removed from the press and the blotters were replaced with one fresh blotter on each side of the mat. This was then pressed again for 1 minute at 1200 PSI. The pressed sheet plus blotters were then dried in a Pako drier (set to 150° C.).

The final sheets (52.5 lbs/ream (24×36 inches-500 sheets)), separated from the blotters, were then cured for 1 hour at 110° C.

The cured sheets were sectioned into four squares, two inches on a side. These squares were then evaluated for acid ink penetration resistance using a green-dyed pH 2.5 formic acid ink (1% formic acid) on a PIP (paper ink penetration) Tester (made by Electronic Specialties of South Plainfield N.J.), which measures the time it takes for the green acid ink to reduce the reflectance of the sheet to 80% of its original value. This reflectance reduction is produced by the penetration of the dyed acid ink through the paper sheet.

The average time to achieve an 80% reflectance value on the sheets to which 0.1% of ASA on the weight of fiber from the "standard" emulsion was added was determined to be 362 seconds. Comparatively, the sheets made using a 0.1% level of ASA added from the waxy maize octenylsuccinate/ASA emulsion gave a sizing value of 1057 seconds, 291% of the "standard" emulsions sizing.

EXAMPLE #2

This example illustrates the effect on the sizing performance of the temperature at which the jet cooking of the starch is performed. Thus, the 3% octenyl succinic anhydride (OSA) modified waxy maize starch was jet cooked over a temperature range of 105° to 160° C. These jet cooks were then used to emulsify ASA in the same manner as set forth in Example #1.

The "standard" ASA emulsion was formed, and handsheets were made using the procedures given in Example #1, at addition levels of ASA on dry fiber weight of 0.1% and 0.2%.

The sizing results (seconds to 80% reflectance) using the PIP tester and a dyed 10% lactic acid ink are summarized below:

| EMULSIFYING SYSTEM | JET COOK TEMP °C. | SIZING @ 0.1% ASA ADDITION | SIZING @ 0.2% ASA ADDITION |
|---|---|---|---|
| Standard | 120° | 97 | 179 |
| 3% OSA waxy maize | 105° | 98 | 340 |
| 3% OSA waxy maize | 120° | 210 | 316 |
| 3% OSA waxy maize | 132° | 276 | 341 |
| 3% OSA waxy maize | 150° | 250 | 291 |
| 3% OSA waxy maize | 160° | 286 | 381 |

The results show the effectiveness of the OSA modified starch as a sizing potentiator as well as the improvement therein as the cooking temperatures increases.

EXAMPLE #3

This Example illustrates the use of the starch emulsified paper sizes of the present invention in an acid papermaking procedure.

ASA was emulsified with the 3% OSA waxy maize under low shear conditions as specified in Example #1, with the use of a 3% solids starch emulsifier solution.

This emulsion was compared to an ASA emulsion made as per U.S. Pat. No. 4,040,900 ("standard") using an amphoteric corn starch at 3% solids as well as with the addition of 7% Surfonic N-95 (Texaco Chemicals) on the weight of ASA and to a rosin soap (Pexol 200, Hercules Inc.).

Handsheets were made as per Example #1 with two changes:

1. The pH of the pulp was dropped to 5.5 to simulate an acidic paper manufacturing system.

2. The percentage of alum on pulp weight was increased from the 0.5% used in Example #1 to 4% to correspond with usage levels encountered during acid papermaking.

The ASA emulsions were then added at a 0.2% ASA addition level on dried paper weight and cured as in Example #1. The rosin soap was added at a 1% addition level on dried paper weight.

The sizing results (seconds to 80% reflectance) using the PIP tester and a dyed 10% lactic acid ink are summarized below:

| EMULSIFYING SYSTEM | PIP SIZING (seconds) |
|---|---|
| Rosin Soap | 411 |
| Standard | 272 |
| 3% OSA waxy maize | 717 |
| 5% OSA waxy maize | 695 |
| 10% OSA waxy maize | 725 |

EXAMPLE #4

ASA was emulsified with the 3, 5 and 10% OSA modified waxy maize starches (Starch A) under low shear conditions as specified in Example #1, except that the starch emulsifier solution was adjusted to 3% solids.

These emulsions were compared to an ASA emulsion made as per U.S. Pat. No. 4,040,900 ("standard") using an amphoteric corn starch as well as with the addition of 7% Surfonic N-95 on the weight of ASA.

The ASA emulsions were then added at 0.2% and 0.4% ASA addition level on dried paper weight, then cured as in Example #1.

The sizing results (seconds to 80% reflectance) using the PIP tester and a dyed 10% lactic acid ink are summarized below:

| EMULSIFYING SYSTEM | PIP SIZING (seconds) @ 0.2% | PIP SIZING (seconds) @ 0.4% |
|---|---|---|
| Standard | 128 | 261 |
| 3% OSA waxy maize | 504 | 659 |
| 5% OSA waxy maize | 680 | 587 |
| 10% OSA waxy maize | 752 | 630 |

EXAMPLE #5

ASA was emulsified with the 3% OSA waxy maize under low shear conditions as specified in Example #1, except that the starch emulsifier solution was adjusted to 3% solids, and that the emulsions were made at 22° C. and 82° C. starch temperatures.

These emulsions were compared to an ASA emulsion made as per U.S. Pat. No. 4,040,900 ("standard") using an amphoteric corn starch as well as with the addition of 7% Surfonic N-95 on the weight of ASA.

The ASA emulsions were then added at a 0.2% ASA addition level on dried paper weight, then cured as in Example #1.

The sizing results (seconds to 80% reflectance using the PIP tester) and a dyed 10% lactic acid ink are summarized below:

| EMULSIFYING SYSTEM | % HYDROLYSIS OF ASA | TEMPERATURE OF EMULSIFICATION | PIP SIZING (seconds) @ 20% |
|---|---|---|---|
| Standard | 5.6 | 22° C. | 106 |
| 3% OSA Waxy Maize | 0.8 | 22° C. | 234 |
| 3% OSA Waxy Maize | 5.2 | 82° C. | 224 |

Not only were the sizing values similar for room temperature and 82° C. emulsification temperatures, but the degree of hydrolysis of the 3% OSA ASA emulsions was lower than the "standard" emulsion, even using a 82° C. starch emulsifier temperature. This reduction in hydrolysis of the reactive sizing agent keeps the system cleaner and consequently improves the machineability. It also makes size usage more efficient.

EXAMPLE #6

ASA was emulsified with a reaction of 5 or 10% OSA modified potato amylose under low shear conditions as specified in Example #1, except that the starch emulsifier solution was adjusted to 3% solids after jet cooking at 120° C.

This emulsion was compared to an ASA emulsion made as per U.S. Pat. No. 4,040,900 ("standard") using an amphoteric corn starch with the addition of 7% Surfonic N-95 on the weight of ASA.

The ASA emulsions were then added at 0.1% and 0.2% ASA addition level on dried paper weight, then cured as in Example #1.

The sizing results (seconds to 80% reflectance) using the PIP tester and a dyed 1% formic acid ink are summarized below:

| EMULSIFYING SYSTEM | PIP SIZING (seconds) @ 0.1% | PIP SIZING (seconds) @ 0.2% |
|---|---|---|
| Standard | 189 | 328 |
| 3% OSA potato amylose | 284 | 500 |
| 5% OSA potato amylose | 199 | 361 |

EXAMPLE #7

ASA was emulsified with quaternary amine derivatives made by reacting 9.3% dimethyl glycidyl-N-decyl ammonium chloride or dimethyl glycidyl-N-lauryl ammonium chloride on waxy maize and with similar derivatives which were also reacted with 4% of diethyl aminoethyl chloride using the basic procedure described in the preparation of Starch C.

These emulsions were made under low shear conditions as specified in Example #1, except that the starch emulsifier solution was adjusted to 1% solids after jet cooking at 160° C.

This emulsion was compared to a ASA emulsion made as per U.S. Pat. No. 4,040,900 using an amphoteric corn starch with the addition of 7% Surfonic N-95 on the weight of ASA.

The ASA emulsions were then added at 0.2% and 0.4% ASA addition level on dried paper weight, then cured as in Example #1. The addition of 0.25% amphoteric corn starch retention aid was made only after the "standard" emulsion, and not after the starch-emulsified ASA.

The sizing results (seconds to 80% reflectance) using the PIP tester and a dyed 1% formic acid ink are summarized below:

| EMULSIFYING SYSTEM | PIP SIZING (seconds) @ 0.2% | PIP SIZING (seconds) @ 0.4% |
|---|---|---|
| Standard | 333 | 678 |
| 1. 9.3% dimethyl glycidyl-N—decyl ammonium chloride on waxy maize | 465 | 972 |
| 2. 9.3% dimethyl glycidyl-N—decyl ammonium chloride + 4% diethyl aminoethyl chloride on waxy maize | 824 | 947 |
| 3. 9.3% dimethyl glycidyl-N—lauryl ammonium chloride on waxy maize | 888 | 950 |
| 4. 9.3% dimethyl glycidyl-N—lauryl ammonium chloride + 4% diethyl aminoethyl chloride on waxy maize | 787 | 1101 |

A sheet was also made after the "standard" sheets were run, with only the addition of 0.8% of hydrophobic starch #3 on sheet weight. This sheet, made without any addition of ASA, gave 677 seconds sizing. The next sheet made in the same manner gave no sizing, indicating the full cleansing of ASA from the headbox and screen. This finding clearly demonstrates the ability of hydrophobic starch derivatives to "scavenge" unretained ASA from the headbox and screen used to form the sheet.

EXAMPLE #8

ASA was emulsified with a reaction of 9.3% dimethyl glycidyl-N-lauryl ammonium chloride plus 4% diethyl aminoethyl chloride on waxy maize and 9.3% dimethyl glycidyl-N-lauryl ammonium chloride on waxy maize as described for Starch C.

These emulsions were made under low shear conditions as specified in Example #1, except that the starch emulsifier solution was adjusted to 1% solids after jet cooking at 150° C., and used at an 8:1 ratio to the ASA.

This emulsion was compared to an ASA emulsion made as per U.S. Pat. No. 4,040,900 using an amphoteric corn starch with the addition of 7% Surfonic N-95 on the weight of ASA.

The ASA emulsions were then added at 0.05, 0.10 and 0.20% ASA addition level on dried paper weight, then cured as in Example #1.

The sizing results (seconds to 80% reflectance) using the PIP tester and a dyed 1% formic acid ink are summarized below:

| EMULSIFYING SYSTEM | PIP SIZING (seconds) @ 0.5% | PIP SIZING (seconds) @ 0.10% | PIP SIZING (seconds) @ 0.20% |
|---|---|---|---|
| Standard | 129 | 413 | 651 |
| 9.3% dimethyl glycidyl-N—lauryl ammonium chloride + 4% diethyl aminoethyl chloride on waxy maize | 1001 | 1204 | 1787 |

EXAMPLE #9

ASA was emulsified with reactions of 8 to 18 carbon chain quaternary amine derivatives on waxy maize prepared as Starch C.

These emulsions were made under low shear conditions as specified in Example #1, except that the starch emulsifier solution was adjusted to 1.54% solids after jet cooking at 150° C., and used at an 8:1 ratio to the ASA.

These emulsions were compared to an ASA emulsion made as per U.S. Pat. No. 4,040,900 using an amphoteric corn starch with the addition of 7% Surfonic N-95 on the weight of ASA.

The ASA emulsions were then added at 0.10% ASA addition level on dried paper weight, then cured as in Example #1.

The sizing results (seconds to 80% reflectance) using the PIP tester and a dyed 1% formic acid ink are summarized below:

| EMULSIFYING SYSTEM | PIP SIZING (seconds) @ .10% |
|---|---|
| Standard | 301 |
| 9.3% dimethyl glycidyl-N—octyl ammonium chloride on waxy maize | 542 |
| 9.3% dimethyl glycidyl-N—decyl ammonium chloride on waxy maize | 820 |
| 9.3% dimethyl glycidyl-N—hexadecyl ammonium chloride on waxy maize | 499 |
| 9.3% dimethyl glycidyl-N—octadecyl ammonium chloride on waxy maize | 872 |

To eliminate the "scavenging" effect, acetone was used to rinse the headbox and screen between the set of sheets made using each starch emulsifier system.

EXAMPLE #10

ASA was emulsified with fatty acid derivatives made by reacting 5 or 10% myristyl-N-methyl imidazolium chloride and 4% of diethyl aminoethyl chloride on waxy maize as described in the preparation of Starch B.

This emulsion was made under low shear conditions as specified in Example #1, except that the 5% fatty ester starch derivative solution was adjusted to 1.52% solids after jet cooking at 120° C. and the 10% fatty ester starch derivative solution was adjusted to 1.12% solids after cooking at 120° C. Both starch emulsifers were used at a 1:1 ratio of starch emulsifier and ASA.

This emulsion was compared to an ASA emulsion made as per U.S. Pat. No. 4,040,900 using an amphoteric corn starch with the addition of 7% Surfonic N-95 on the weight of ASA.

The ASA emulsions were then added at 0.2% and 0.4% ASA addition level on dried paper weight, then cured as in Example #1.

The sizing results (seconds to 80% reflectance) using the PIP tester and a dyed 1% formic acid ink are summarized below:

| EMULSIFYING SYSTEM | PIP SIZING (seconds) @ 0.2.% | PIP SIZING (seconds) @ 0.4.% |
|---|---|---|
| Standard | 477 | 642 |
| 5% myristyl-N—methyl | 794 | 682 |

-continued

| EMULSIFYING SYSTEM | PIP SIZING (seconds) @ 0.2.% | PIP SIZING (seconds) @ 0.4.% |
|---|---|---|
| imidazolium chloride + 4% diethyl aminoethyl chloride on waxy maize | | |
| 10% myristyl-N—methyl imidazolium chloride + 4% diethyl aminoethyl chloride on waxy maize | 722 | 757 |

A sheet was formed after all the sheets containing ASA emulsion had been made, with only the addition of 0.8% of 10% myristyl-N-methyl imidazolium chloride on waxy maize on sheet weight. The next two sheets, made without any addition of ASA, averaged 841 seconds sizing. The next four sheets made in the same manner averaged 1.7 seconds sizing, indicating the full cleansing or scavenging of the headbox and screen from unretained ASA.

EXAMPLE #11

ASA was emulsified with the 3% OSA waxy maize under low shear conditions as specified in Example #1, except that the starch emulsifier solution was adjusted to 3% solids. The 3% OSA waxy maize was jet cooked as given in EXAMPLE #1, except at 140° C.

These emulsions were compared to a ASA emulsion made as per U.S. Pat. No. 4,040,900 using an amphoteric corn starch as well as with the addition of 7% Surfonic N-95 on the weight of reactive size.

The ASA emulsions were then added at a 0.2% ASA addition level on dried paper weight, then cured as in Example #1.

The sizing results (seconds to 80% reflectance) using the PIP tester and a dyed 1% formic acid ink are summarized below:

| EMULSIFYING SYSTEM | PIP SIZING (Seconds) @ .20% |
|---|---|
| Standard | 367 |
| 3% OSA waxy maize (fresh emulsion) | 514 |
| 3% OSA waxy maize (emulsion aged 2 hrs.) | 555 |

These results show that aging of the 3% OSA waxy maize/ASA emulsion had no negative effect on its sizing ability.

EXAMPLE #12

ASA and a reaction product of 20% maleic anhydride with corn oil were emulsified with the 3% OSA waxy maize under low shear conditions as specified in Example #1, using a 3% starch solids emulsifier solution (jet cooked under the condition specified in Example #1).

These emulsions were compared to ASA ("standard") and 20% maleated corn oil ("standard A") emulsions made as per U.S. Pat. No. 4,040,900 using an amphoteric corn starch at 3% solids as well as with the addition of 7% Surfonic N-95 on the weight of reactive size.

Handsheets were made as per Example #1 with two changes:

1. The pH of the pulp was dropped to 5.0 to simulate an acidic paper manufacturing system.

2. The percentage of alum on pulp weight was increased from the 0.5% used in Example #1 to 4% to correspond with usage levels encountered during acid papermaking.

The reactive size emulsions were then added to a 0.4% size addition level on dried paper weight and cured as in Example #1.

The sizing results (seconds to 80% reflectance) using the PIP tester and a dyed 1% formic acid ink are summarized below:

| EMULSIFYING SYSTEM | PIP SIZING (seconds) |
|---|---|
| Standard | 998 |
| Standard A | 287 |
| 3% OSA waxy maize/ASA | 1241 |
| 3% OSA waxy maize/20% maleated corn oil | 611 |

Both types of reactive sizes showed synergistic improvements in sizing when the 3% OSA waxy maize was used as the emulsification system. This demonstrates the ability of the OSA/waxy maize to synergistically improve the sizing performance of cellulose-reactive sizes other than ASA.

EXAMPLE #13

ASA was emulsified with reactions of an 8 carbon chain quaternary amine on non-degraded, 30, 60 and 80 water fluidity (WF) waxy maize bases.

These emulsions were made under low shear conditions as specified in Example #1, except that the starch emulsifier solution was adjusted to 0.38% solids after jet cooking at 150° C., and used at an 2:1 ratio to the ASA.

These emulsions were compared to a ASA emulsion made as per U.S. Pat. No. 4,040,900 using an amphoteric corn starch with the addition of 7% Surfonic N-95 on the weight of reactive size.

The ASA emulsions were then added at 0.20% ASA addition level on dried paper weight, then cured as in Example #1.

The sizing results (seconds to 80% reflectance) using the PIP tester and a dyed 1% formic acid ink are summarized below:

| EMULSIFYING SYSTEM | PIP SIZING (seconds) @ .20% |
|---|---|
| Standard | 521 |
| 9.3% dimethyl glycidyl-N—octyl ammonium chloride on non-degraded waxy maize | 746 |
| 9.3% dimethyl glycidyl-N—octyl ammonium chloride on 30 WF waxy maize | 782 |
| 9.3% dimethyl glycidyl-N—octyl ammonium chloride on 60 WF waxy maize | 840 |
| 9.3% dimethyl glycidyl-N—octyl ammonium chloride on 80 WF waxy maize | 836 |

To eliminate the "scavenging" effect, a blank sheet containing only 0.4% of the non-degraded dimethyl glycidyl-N-octyl ammonium chloride on waxy maize was made between each sheet, and discarded.

These results indicate that acid fluidity versions of the 8 carbon quaternary amine derivative of waxy maize are more efficient synergists for the sizing performance of the ASA than the non-degraded polysaccharide emulsifier.

EXAMPLE #14

Ketene dimer (Aquapel from Hercules, Inc.) and distearic anhydride were emulsified on a laboratory scale in a Cenco cup with a 3% OSA waxy maize as specified in Example #1, except that the starch emulsifier solution was adjusted to 3% solids and used at 82° C.

The starch emulsifier was jet cooked as given in Example #1.

These emulsions were compared to emulsions of the ketene dimer and distearic anhydride) as per U.S. Pat. No. 4,040,900 using an amphoteric corn starch (standard #1) as well as the addition of 7% Surfonic N-95 (standard #2) and made in a Cenco cup. These emulsions were then added at a 0.2% reactive size addition level on dried paper weight, then cured as in Example #1.

The sizing results (seconds to 80% reflectance) using the PIP tester and a dyed 1% formic acid ink are summarized below:

| EMULSIFYING SYSTEM | PIP SIZING (seconds) @ .20% |
|---|---|
| Standard #1 | 519 |
| Standard #2 | 28 |
| 3% OSA waxy maize/Ketene Dimer | 577 |
| 3% OSA waxy maize/Distearic Anhydride | 49 |

This example shows that the synergistic sizing performance improvement due to use of the hydrophobic starch emulsifiers is not dependent on the reactive size type, as not only substituted cyclic anhydrides show such sizing improvements, but also linear anhydrides as well as ketene dimer.

EXAMPLE #15

ASA was emulsified with reactions of 3% OSA on a non-degraded waxy maize and on 85 water fluidity (WF) bases.

These emulsions were made under low shear conditions as specified in Example #1, except that the starch emulsifier solution was adjusted to 3.0% solids for the non-degraded and 10% solids for the 85 WF 3% OSA waxy maize after jet cooking at 150° C., and used at a 2:1 ratio to the ASA.

These emulsions were compared to a ASA emulsion made as per U.S. Pat. No. 4,040,900 using an amphoteric corn starch with the addition of 7% Surfonic N-95 on the weight of reactive size.

The ASA emulsions were then added at 0.10% and 0.20% ASA addition level on dried paper weight, then cured as in Example #1.

The sizing results (seconds to 80% reflectance) using the PIP tester and a dyed 1% formic acid ink are summarized below:

| EMULSIFYING SYSTEM | PIP SIZING (seconds) 0.10% | PIP SIZING (seconds) @ 0.20% |
|---|---|---|
| Standard | 207 | 307 |
| 3% OSA waxy maize (non-degraded) | 543 | 640 |
| 3% OSA waxy maize (85 WF) | 450 | 483 |

To eliminate the "scavenging" effect, a blank sheet containing only 0.4% of the non-degraded 3% OSA waxy maize was made between each sheet, and discarded.

These results indicate that an acid fluidity version of the OSA derivative of waxy maize is nearly as efficient a synergist for the sizing performance of the ASA as the non-degraded version.

EXAMPLE #16

ASA was emulsified with reaction products of 3% OSA or 6% OSA treatment on a non-degraded corn starch, 3% OSA on tapioca starch, 3% OSA on a waxy maize dextrin (Capsul from National Starch and Chemical Corp.), and a reaction of 10% tetradecyl succinic anhydride on waxy maize.

These emulsions were made under low shear conditions as specified in Example #1, except that the starch emulsifier solution was adjusted to 3.0% solids for the non-degraded and 30% solids for the Capsul dextrin after jet cooking at 300° F., and used at an 2:1 ratio to the ASA.

These emulsions were compared to a ASA emulsion made as per U.S. Pat. No. 4,040,900 using an amphoteric corn starch with the addition of 7% Surfonic N-95 on the weight of reactive size.

The ASA emulsions were then added at a 0.10% ASA addition level on dried paper weight, then cured as in Example #1.

The sizing results (seconds to 80% reflectance) using the PIP tester and a dyed 1% formic acid ink are summarized below:

| EMULSIFYING SYSTEM | PIP SIZING (seconds) 0.10% |
|---|---|
| Standard | 191 |
| 3% OSA corn starch | 337 |
| 6% OSA corn starch | 466 |
| 3% OSA tapioca starch | 474 |
| 3% OSA waxy maize dextrin | 236 |
| 10% TDSAA waxy maize | 340 |

To eliminate the "scavenging" effect, a blank sheet containing only 0.4% of the non-degraded 3% OSA waxy maize was made between each sheet and discarded.

These results indicate that a dextrin version of the OSA derivative of waxy maize is an effective synergist for the sizing performance of the ASA. In addition, this synergism shown by the OSA waxy maize derivatives is not due to the starch base used, as both corn and tapioca starches, when reacted with OSA, greatly improve the sizing performance of the ASA when used to replace the surfactant and amphoteric corn starch in the "standard" ASA emulsification system.

The tetradecylsuccinic anhydride reaction product of waxy maize, a 14 carbon version of the 8-carbon OSA waxy maize, also shows the ability to synergistically improve the performance of the ASA size.

EXAMPLE #17

ASA was emulsified with reactions of 1% OSA or 2% OSA on a waxy maize starch, a reaction of 10% tetradecyl succinic anhydride on corn starch and a reaction of 25% OSA on guar gum.

These emulsions were made under low shear conditions as specified in Example #1, except that the starch emulsifier solution was adjusted to 3.0% solids after jet cooking at 300° F., and used at an 2:1 ratio to the ASA.

These emulsions were compared to an ASA emulsion made as per U.S. Pat. No. 4,040,900 using an amphoteric corn starch with the addition of 7% Surfonic N-95 on the weight of reactive size.

The ASA emulsions were then added at a 0.10% ASA addition level on dried paper weight, then cured as in Example #1.

The sizing results (seconds to 80% reflectance) using the PIP tester and a dyed 1% formic acid ink are summarized below:

| EMULSIFYING SYSTEM | PIP SIZING (seconds) 0.10% |
|---|---|
| Standard | 168 |
| 1% OSA waxy maize starch | 379 |
| 2% OSA waxy maize starch | 345 |
| 25% OSA guar gum | 232 |
| 10% TDSAA corn starch* (Run at 82° C.) | 369 |

To eliminate the "scavenging" effect, a blank sheet containing only 0.4% of the 3% OSA waxy maize was made between each sheet, and discarded.

These results indicate that lower levels of OSA on waxy maize, as well as an OSA/guar gum reaction product, are effective synergists for the sizing performance of the ASA.

The tetradecylsuccinic anhydride reaction product of corn starch, in the same manner as the equivalent waxy maize derivative, also shows the ability to synergistically improve the performance of the ASA size.

It will be apparent that various changes and modifications may be made in the embodiments of the invention described above, without departing from the scope of the invention, as defined in the appended claims, and it is intended therefore, that all matter contained in the foregoing description shall be interpreted as illustrative only and not as limiting the invention.

We claim:

1. Paper or paperboard prepared by a method comprising the steps of:

(a) providing a paper stock system;

(b) forming in the absence of high shearing forces and under normal pressures, a sizing emulsion consisting essentially of water and 0.1 to 15% by weight of at least one hydrophobic sizing agent selected from the group consisting of alkyl ketene dimers, anhydrides of fatty acids, maleated triglycerides, maleated alpha-olefins, maleated fatty acids and substituted linear or cyclic dicarboxylic acid anhydrides and 0.4 to 30% by weight of a jet cooked dispersion of a hydrophobic starch ether or ester derivative wherein the ether or ester substituent comprises a saturated or unsaturated hydrocarbon chain of at least 5 carbon atoms in the alkyl chain or a dispersion of a corresponding derivative gum;

(c) forming a web from the paper stock system;

(d) dispersing said emulsion within the paper stock either before or after formation of said web but prior to passing said web through the drying stage of the paper making operation in an amount sufficient to provide a concentration of the sizing agent of from 0.01% to 2%, based on dry fiber weight.

2. The paper or paperboard of claim 1 wherein the size emulsion contains a jet cooked dispersion of a derivative of starch.

3. A method for sizing paper products comprising the steps of:

(a) providing a paper stock system;

(b) forming in the absence of high shearing forces and under normal pressures, a sizing emulsion consisting essentially of water and 0.1 to 15% by weight of at least one hydrophobic sizing agent selected from the group consisting of alkyl ketene dimers, anhydrides of fatty acids, maleated triglycerides, maleated alphaolefins, maleated fatty acids and substituted linear or cyclic cicarboxylic acid anhydrides and 0.4 to 30% by weight of a jet cooked dispersion of a hydrophobic starch ether or ester derivative wherein the ether or ester substituent comprises a saturated or unsaturated hydrocarbon chain of at least 5 carbon atoms in the alkyl chain or a dispersion of a corresponding derivative gum;

(c) forming a web from the paper stock system;

(d) dispersing said emulsion within the paper stock either before or after formation of said web but prior to passing said web through the drying stage of the paper making operation in an amount sufficient to provide a concentration of the sizing agent of from 0.01% to 2%, based on dry fiber weight.

4. The method of claim 3 wherein the size emulsion contains a jet cooked dispersion of a derivatives of starch.

5. Paper or paperboard prepared by the method of claim 4.

6. The method of claim 3 wherein there is additionally added a cationic retention agent in an amount sufficient to provide 0.01 to 3% by weight of the retention agent on the dry fiber weight.

7. The method of claim 3 wherein the hydrophobic sizing agent is a substituted linear or cyclic dicarboxylic acid anhydride.

8. The method of claim 3 wherein the hydrophobic sizing agent is represented by the following formula:

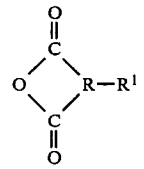

wherein R represents a dimethylene or trimethylene radical and wherein R′ is a hydrophobic group containing more than 4 carbon atoms which may be selected from the class consisting of alkyl, alkenyl, aralkyl or aralkenyl groups.

9. The method of claim 3 wherein the hydrophobic sizing agent is an alkenyl succinic acid anhydride.

10. The method of claim 3 wherein the hydrophobic sizing agent is a higher organic ketene dimer of the following formula:

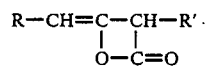

wherein R and R′ are independently chosen from the group consisting of saturated and unsaturated alkyl radicals having at least eight carbon atoms, cycloalkyl radicals having at least six carbon atoms, aryl, aralkyl and alkaryl radicals.

11. The method of claim 3 wherein the starch or gum derivative is prepared by treating the starch of gum with at least 1% by weight of the polysaccharide of the long chain alkyl derivatizing reagent.

12. The method of claim 11 wherein the starch or gum derivative is prepared by treating the starch or gum with 3–20% by weight of the starch of the derivatizing reagent.

13. The method of claim 11 wherein the starch or gum derivative is prepared by treating the starch or gum with 3–10% by weight of the derivatizing reagent.

14. A method for sizing paper products comprising the steps of:

(a) providing a paper stock system;

(b) forming in the absence of high shearing forces and under normal pressures, a sizing emulsion consisting essentially of water and 0.1 to 15% by weight of at least one hydrophobic sizing agent selected from the group consisting of alkyl ketene dimers, anhydrides of fatty acids, maleated triglycerides, maleated alpha-olefins, maleated fatty acids and substituted linear or cyclic dicarboxylic acid anhydrides and 0.4 to 30% by weight of a jet cooked dispersion of a hydrophobic starch ether or ester derivative wherein the ether or ester substituent comprises a unsaturated hydrocarbon chain of at least 5 carbon atoms in the alkyl chain;

(c) forming a web from the paper stock system;

(d) dispersing said emulsion within the paper stock either before or after formation of said web but prior to passing said web through the drying stage of the paper making operation in an amount sufficient to provide a concentration of the sizing agent of from 0.01% to 2%, based on dry fiber weight.

15. The method of claim 14 wherein the derivative of starch is a cationic ether, succinate ester or fatty acid ester.

16. The method of claim 14 wherein the starch is selected from the group consisting of corn, waxy maize, potato, tapioca, and high amylose corn.

17. The method of claim 14, wherein the starch derivative is an ester prepared from a substituted cyclic dicarboxylic acid anhydride having the structure

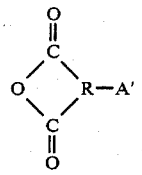

wherein R is a dimethylene or trimethylene radical and A′ comprises a hydrocarbon chain of at least 5 carbon atoms.

18. The method of claim 17 wherein the starch derivative is prepared from an alkenyl succinic acid anhydride.

19. The method of claim 14 wherein the starch derivative is prepared from the imidazolides or N,N′-disubstituted imidazolium salts of carboxylic or sulfonic acids having the general formula

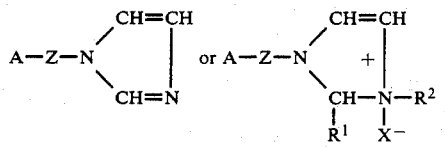

wherein Z is

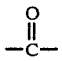

or $—SO_2—$, A comprises a hydrocarbon chain of at least 5, carbon atoms, $R^1$ is H or $C_1$–$C_4$ alkyl, $R^2$ is $C_1$–$C_4$ alkyl, and $X^-$ is an anion.

20. The method of claim 14 wherein the starch derivative is prepared from the reaction product of an epihalohydrin with a tertiary amine having the structure

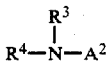

wherein $R^3$ and $R^4$ are independently H or a $C_1$–$C_4$ alkyl and $A^2$ comprises a hydrocarbon chain of at least 5 carbon atoms.

* * * * *

UNITED STATES PATENT AND TRADEMARK OFFICE

CERTIFICATE OF CORRECTION

PATENT NO. : 4,721,655

DATED : January 26, 1988

INVENTOR(S) : Peter T. Trzasko, et al.

It is certified that error appears in the above-identified patent and that said Letters Patent are hereby corrected as shown below:

Column 4, line 66, "of" should be -- or --.

Column 6, line 32-35, the structure should read as follows:

$$R^4 - \overset{\displaystyle R^3}{\overset{|}{N}} - A^2$$

Column 10, line 4, "halfacid" should be -- half-acid --.

Column 11, line 26, "to pH to 8.5" should be -- to pH 8.5 --.

Column 22, line 14, "cicarboxylic" should be -- dicarboxylic --.

Column 22, line 29, "derivatives" should be -- derivative --.

Signed and Sealed this

Twenty-sixth Day of July, 1988

*Attest:*

DONALD J. QUIGG

*Attesting Officer*

*Commissioner of Patents and Trademarks*